US012607384B2

(12) United States Patent
Kadowaki et al.

(10) Patent No.: US 12,607,384 B2
(45) Date of Patent: Apr. 21, 2026

(54) CHILLING UNIT AND CHILLING-UNIT SYSTEM

(71) Applicant: Mitsubishi Electric Corporation, Tokyo (JP)

(72) Inventors: Kimitaka Kadowaki, Tokyo (JP); Junichi Miyai, Tokyo (JP); Yuji Tarumi, Tokyo (JP); Takuya Ito, Tokyo (JP); Tomoya Kimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 123 days.

(21) Appl. No.: 18/293,498

(22) PCT Filed: Sep. 29, 2021

(86) PCT No.: PCT/JP2021/035902
§ 371 (c)(1),
(2) Date: Jan. 30, 2024

(87) PCT Pub. No.: WO2023/053280
PCT Pub. Date: Apr. 6, 2023

(65) Prior Publication Data
US 2024/0337414 A1 Oct. 10, 2024

(51) Int. Cl.
*F24F 13/30* (2006.01)
*F28C 1/00* (2006.01)
*F24F 13/20* (2006.01)

(52) U.S. Cl.
CPC ..... *F24F 13/30* (2013.01); *F24F 2013/202* (2013.01); *F28C 1/00* (2013.01)

(58) Field of Classification Search
CPC ..... F24F 13/30; F24F 2013/202; F28C 1/00
See application file for complete search history.

(56) References Cited

U.S. PATENT DOCUMENTS

2008/0156014 A1* 7/2008 Kopko ..... F28F 9/026 62/314
2011/0192188 A1* 8/2011 Nickey ..... F24F 13/30 165/104.34

(Continued)

FOREIGN PATENT DOCUMENTS

CN 114797467 A * 7/2022 ..... F28F 25/08
JP S61-034022 U 3/1986

(Continued)

OTHER PUBLICATIONS

International Search Report of the International Searching Authority mailed Nov. 9, 2021 in corresponding International Application No. PCT/JP2021/035902 (and English translation).

*Primary Examiner* — Paul Alvare
(74) *Attorney, Agent, or Firm* — Posz Law Group, PLC

(57) ABSTRACT

A chilling unit includes a machine chamber unit formed in an elongated box shape; and air heat exchangers placed on the machine chamber unit. A pair of the air heat exchangers that is located opposite to each other in a short-side direction of the machine chamber unit is inclined such that a spacing between upper end portions of the pair is greater than a spacing between lower end portions of the pair, a machine chamber panel forming a side face of the machine chamber unit in the short-side direction includes a panel body positioned at a central portion of the machine chamber panel, and a fixing portion connected to a periphery of the panel body and fixed in contact with the machine chamber unit, and the panel body is located further outward from the machine chamber unit than is the fixing portion.

10 Claims, 14 Drawing Sheets

(56) References Cited

U.S. PATENT DOCUMENTS

| | | | | |
|---|---|---|---|---|
| 2012/0125033 | A1* | 5/2012 | Tanno | F25B 13/00 165/181 |
| 2018/0080667 | A1* | 3/2018 | Nishimoto | F24F 1/16 |
| 2022/0252281 | A1 | 8/2022 | Mukaitani et al. | |

FOREIGN PATENT DOCUMENTS

| | | | | | |
|---|---|---|---|---|---|
| JP | H02187577 | A | * | 7/1990 | |
| JP | 2004076990 | A | * | 3/2004 | |
| JP | 2007163017 | A | * | 6/2007 | |
| JP | 2012-013302 | A | | 1/2012 | |
| JP | 5500725 | B2 | | 5/2014 | |
| KR | 20140101363 | A | * | 8/2014 | F24F 1/50 |
| WO | WO-2018070143 | A1 | * | 4/2018 | F24F 1/18 |
| WO | 2020/035945 | A1 | | 2/2020 | |
| WO | 2021/024405 | A1 | | 2/2021 | |

* cited by examiner

CHILLING UNIT AND CHILLING-UNIT SYSTEM

CROSS REFERENCE TO RELATED APPLICATION

This application is a U.S. national stage application of PCT/JP2021/035902 filed on Sep. 29, 2021, the contents of which are incorporated herein by reference.

TECHNICAL FIELD

The present disclosure relates to a chilling unit that corresponds to an air-conditioning apparatus, a heat-pump hot water supply device, a refrigeration device, or other devices, and also relates to a chilling-unit system having a plurality of the chilling units.

BACKGROUND

Some chilling unit that is a heat-pump type heat source unit has been proposed. The chilling unit has heat-pump constituent devices accommodated in a housing of the chilling unit, such as a heat exchanger for air, an air-sending device, a compressor, and a heat exchanger (see, for example, Patent Literature 1). The chilling unit disclosed in Patent Literature 1 includes a housing made up of an upper housing and a lower housing. The heat exchanger for air and the air-sending device are housed in the upper housing, while the compressor and the heat exchanger are housed in the lower housing. The upper housing is formed such that its left and right side faces in front view are inclined and its width is thus reduced downward. The lower housing is provided continuously from a lower face of the upper housing.

PATENT LITERATURE

Patent Literature 1: Japanese Patent No. 5500725

A plurality of the chilling units disclosed in Patent Literature 1 may be arranged side by side. To minimize, to the extent possible, the installation space of the chilling units, they are arranged in proximity to each other to an extent such that at least each upper housing that is relatively wide is prevented from contacting the upper housings of the adjacent chilling units. In this case, a space between the lower housings of the adjacent chilling units is used as, for example, a service space for inspecting or repairing devices inside the lower housings such as a compressor, a control box, and an accumulator. In each of the chilling units, the upper housing is thus formed and has a relatively small width of its upper portion to minimize, to the extent possible, the installation space, while the lower housing is thus formed and has a width as small as possible to ensure the service space. This structure thus has no extra space inside the lower housing, and the devices inside the lower housing are thus partially in contact with, or in close proximity to, panels making up the outer shell of the lower housing.

A countermeasure may be necessary for the panels, such as attaching an additional part such as a heat insulating material to a portion of the panel with which the devices are partially in contact, or to which the devices are partially in close proximity. Thus, although a plurality of the panels making up the outer shell of the lower housing are all formed in the same panel structure, depending on the position where each individual panel is attached to the chilling unit, the position of the additional part to be fixed to the panel differs between the panels. Therefore, this results in a problem in that there is no interchangeability between the plurality of panels.

SUMMARY

It is an object of the present disclosure to provide a chilling unit and a chilling-unit system that ensures interchangeability between a plurality of panels making up an outer shell of a lower housing of the chilling unit without increasing an installation area.

A chilling unit according to an embodiment of the present disclosure includes a machine chamber unit formed in an elongated box shape and that houses a compressor and a heat exchanger in the machine chamber unit; and a plurality of air heat exchangers making up, along with the compressor and the heat exchanger, a refrigerant circuit, the plurality of air heat exchangers being placed on a top portion of the machine chamber unit. A pair of air heat exchangers of the plurality of air heat exchangers, located opposite to each other in a short-side direction of the machine chamber unit, is disposed and inclined such that a spacing between upper end portions farther than lower end portions from the machine chamber unit is greater than a spacing between the lower end portions closer than the upper end portions to the machine chamber unit, a machine chamber panel forming a side face of the machine chamber unit in the short-side direction includes a panel body positioned at a central portion of the machine chamber panel, and a fixing portion connected to a periphery of the panel body and fixed to the machine chamber unit in contact with the machine chamber unit, and the panel body is located further outward from the machine chamber unit than is the fixing portion.

A chilling-unit system according to an embodiment of the present disclosure is a chilling-unit system made up of a plurality of the chilling units described above. A spacing between the machine chamber units of two of the plurality of the chilling units adjacent to each other in the short-side direction is set greater than or equal to 350 mm.

According to an embodiment of the present disclosure, in the chilling unit, the panel body having a flat-plate shape, located at the central portion of the panel, and covering the machine chamber unit is positioned further outward than is the fixing portion. This allows the machine chamber unit to ensure an increased area for devices to be located inside the machine chamber unit. Even in a case where a heat insulating part is fixed to the panel body, it is still unnecessary to form the heat insulating part appropriate to the devices inside the machine chamber unit. Therefore, there is interchangeability between a plurality of panels, which results in a reduction in time and labor in managing the panels during removal and attachment work.

DETAILED DESCRIPTION

Figure 1:
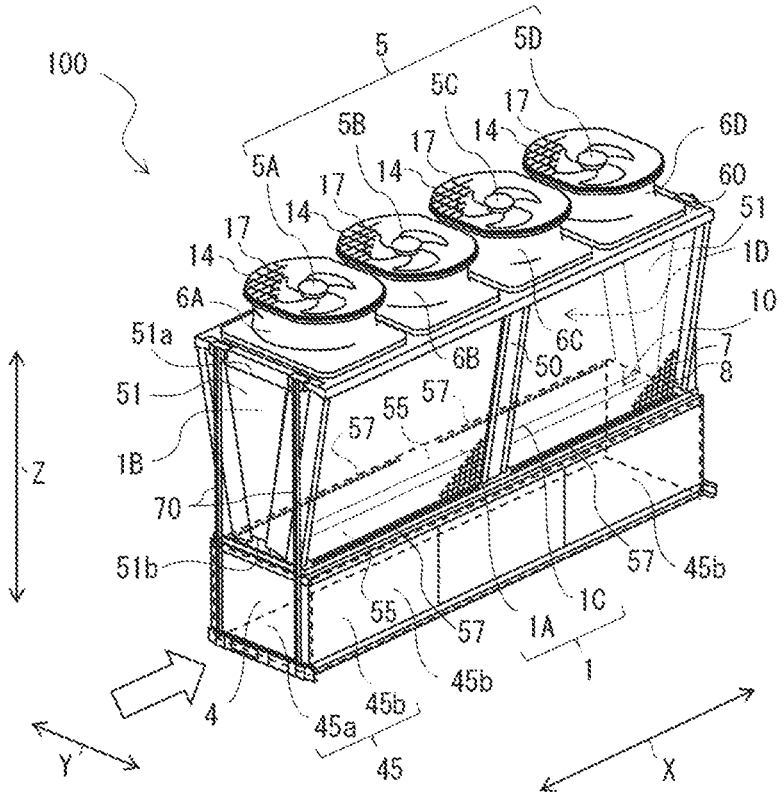
FIG. 1 is a perspective view of a chilling unit 100 according to Embodiment 1.

Hereinafter, a chilling unit 100 and a chilling-unit system 110 according to an embodiment will be described with reference to the drawings and other reference. Note that the relative relationship of sizes of the components, the shapes of the components, and other aspects in the drawings below including FIG. 1 may differ from those of actual ones. In the drawings below, the same reference signs denote the same or equivalent components, which are common throughout the entire specification. For purposes of easy understanding, directional terms (for example, "up," "down," "right," "left," "front," and "rear") may be appropriately used. These directional terms are solely described for convenience of explanation, and are not intended to limit the location and orientation of the device or the component.

Embodiment 1

[Chilling Unit 100]

Figure 2:
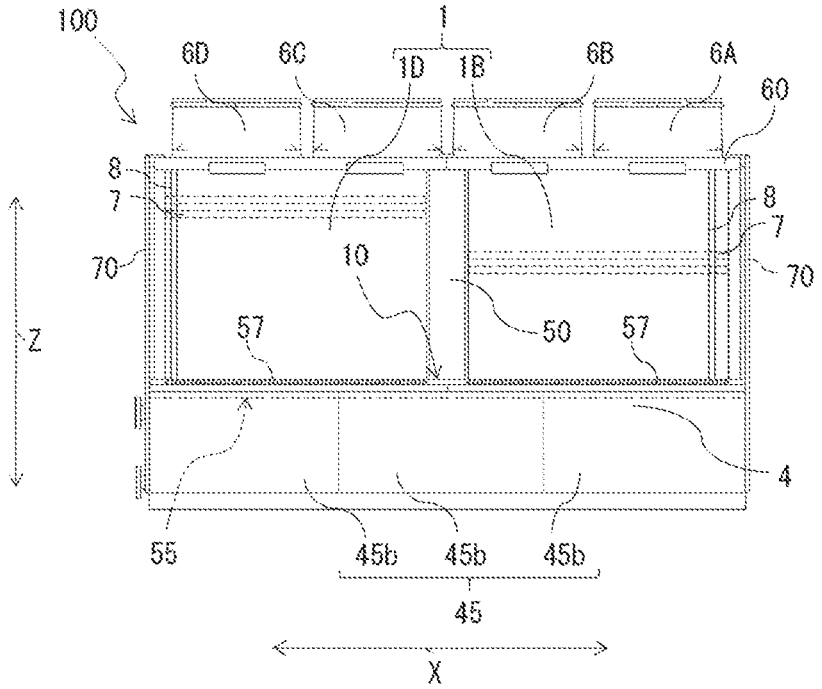
FIG. 2 is a side view of the chilling unit 100 according to Embodiment 1.
Figure 3:
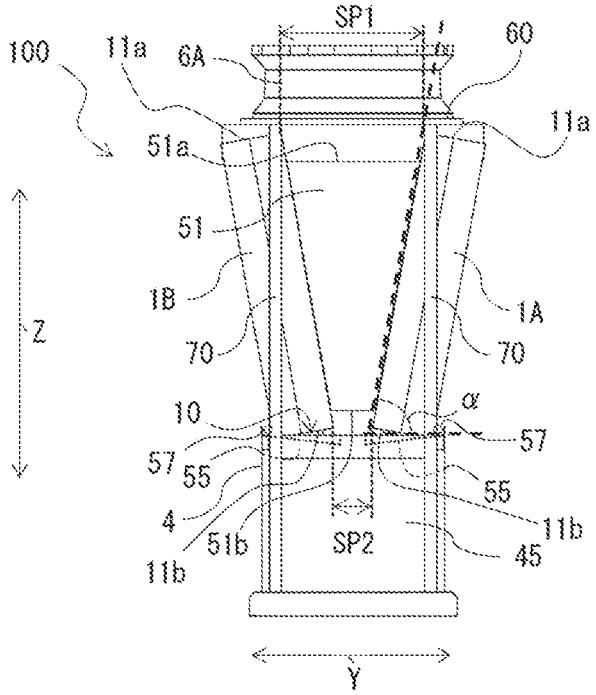
FIG. 3 is a front view of the chilling unit 100 according to Embodiment 1.

FIG. 1 is a perspective view of the chilling unit 100 according to Embodiment 1. FIG. 2 is a side view of the chilling unit 100 according to Embodiment 1. FIG. 3 is a front view of the chilling unit 100 according to Embodiment 1. Note that FIG. 3 is a front view of the chilling unit 100 viewed in an open-arrow direction in FIG. 1. With reference to FIGS. 1 to 3, the overall configuration of the chilling unit 100 is described below. Note that the X-axis illustrated in the drawings below including FIG. 1 shows a longitudinal direction of the chilling unit 100, the Y-axis shows a width direction or a left-right direction of the chilling unit 100, and the Z-axis shows an up-down direction of the chilling unit 100. The positional relationship between the components in the specification (for example, relationship in the up-down direction) is basically the positional relationship in a case where the chilling unit 100 is installed in a usable state.

The chilling unit 100 is utilized as, for example, a heat source device of a chiller apparatus. Heat transfer fluid such as water and antifreeze is supplied from a load-side unit (not illustrated) to the chilling unit 100. Then, the heat transfer fluid is cooled or heated in the chilling unit 100 and is fed to the load-side unit. The chilling unit 100 causes the heat transfer fluid to circulate in this manner, thereby to supply cooling energy or heating energy to the load-side unit.

The chilling unit 100 is formed into an elongated shape, and has an air heat exchanger 1 forming a refrigeration cycle on the heat source side, a fan 5, and a machine chamber unit 4.

(Air Heat Exchanger 1)

The air heat exchanger 1 is configured to allow refrigerant flowing in the air heat exchanger 1 and outside air to exchange heat between them, and serves as an evaporator or a condenser. The air heat exchanger 1 has a plurality of heat transfer tubes 7 and a plurality of fins 8. The air heat exchanger 1 is, for example, a parallel-flow heat exchanger having a pair of headers (not illustrated), a plurality of heat transfer tubes 7, and a plurality of fins 8. Each of the heat transfer tubes 7 is, for example, an aluminum flat tube. Each of the fins 8 is, for example, a corrugated fin. Note that the air heat exchanger 1 is not limited to the parallel-flow heat exchanger. For example, the air heat exchanger 1 may be a fin-and-tube heat exchanger in which a plurality of plate fins 8 are arranged in parallel to each other, and the heat transfer tubes 7 penetrate through the plurality of plate fins 8. The air heat exchanger 1 includes four air heat exchangers 1, which are an air heat exchanger 1A, an air heat exchanger 1B, an air heat exchanger 1C, and an air heat exchanger 1D. The air heat exchanger 1A is a first air heat exchanger. The air heat exchanger 1B is a second air heat exchanger. The air heat exchanger 1C is a third air heat exchanger. The air heat exchanger 1D is a fourth air heat exchanger.

In a short-side direction (Y-axis direction) of the machine chamber unit 4, the air heat exchanger 1A and the air heat exchanger 1B are located opposite to each other. A pair of the air heat exchangers 1 that are the air heat exchangers 1A and 1B is disposed and inclined in such a manner that an upper spacing SP1 between upper end portions 11*a* of the air heat exchangers 1A and 1B farther than lower end portions 11*b* from the machine chamber unit 4 is greater than a lower spacing SP2 between the lower end portions 11*b* of the air heat exchangers 1A and 1B closer than the upper end portions 11*a* to the machine chamber unit 4. That is, as illustrated in FIG. 3, the air heat exchangers 1A and 1B are disposed and inclined such that a V-shape is formed when the air heat exchangers 1A and 1B are viewed from the front of the chilling unit 100. In the short-side direction (Y-axis direction) of the machine chamber unit 4, the air heat exchangers 1C and 1D that are opposite to each other are also disposed and inclined such that a V-shape is formed similarly to the air heat exchangers 1A and 1B. In Embodiment 1, an inclination angle $\alpha$ of the air heat exchanger 1A is, for example, 65 to 80 degrees. The air heat exchangers 1B, 1C, and 1D are also disposed and each have an inclination angle of 65 to 80 degrees similarly to the air heat exchanger 1A.

A top frame 60 is provided above the air heat exchangers 1A, 1B, 1C, and 1D. The top frame 60 corresponds to the upper wall of the chilling unit 100. The top frame 60 is fixed to the machine chamber unit 4 through support pillars 70. The support pillars 70 are provided at respective opposite end portions of the chilling unit 100 in the longitudinal direction (X-axis direction). Two support pillars 70 are located at each of the end portions of the chilling unit 100 in the longitudinal direction (X-axis direction). The two support pillars 70 are located extending in the up-down direction, while being spaced apart from each other in the short-side direction (Y-axis direction). The support pillars 70 are fixed at their upper end portions to the top frame 60, while being fixed at their lower end portions to the machine chamber unit 4.

In the short-side direction (Y-axis direction) of the chilling unit 100, on one side face of the chilling unit 100, a side panel 50 is located and covers the space between the air heat exchangers 1A and 1C. The side panel 50 is a plate-like panel formed into a substantially rectangular shape. The side panel 50 is provided and extends in the up-down direction (Z-axis direction) and in the longitudinal direction (X-axis direction). The side panel 50 is disposed along the inclination of the air heat exchanger 1 described above. Note that in the short-side direction (Y-axis direction) of the chilling unit 100, on the other side face of the chilling unit 100, another side panel 50 is located and covers the space between the air heat exchangers 1B and 1D.

In the longitudinal direction (X-axis direction) of the chilling unit 100, on one side face of the chilling unit 100, a side panel 51 is located and covers the space between the air heat exchangers 1A and 1B. The side panel 51 is a plate-like panel formed into a substantially trapezoidal shape. The side panel 51 has its upper edge portion 51*a* longer than its lower edge portion 51*b*. The side panel 51 is provided and extends in the up-down direction (Z-axis direction) and in the short-side direction (Y-axis direction).

In the longitudinal direction (X-axis direction) of the chilling unit 100, the side panel 51 is located to partially cover the end portions of the air heat exchangers 1A and 1B. Note that in the longitudinal direction (X-axis direction) of the chilling unit 100, on the other side face of the chilling unit 100, another side panel 51 is located and covers the space between the air heat exchangers 1C and 1D. In the longitudinal direction (X-axis direction) of the chilling unit 100, the other side panel 51 is located to partially cover the end portions of the air heat exchangers 1C and 1D.

(Fan 5)

The fan 5 described above is provided on the top frame 60. The fan 5 is configured to form a flow of air that passes through the air heat exchanger 1 and is discharged from an air outlet 14 of a bell mouth 6A or other bell mouth described later. The fan 5 is an air sending means including an axial flow fan, and is configured to generate a flow of air that helps to efficiently exchange heat in the air heat exchanger 1. The fan 5 includes four fans 5, which are a fan 5A, a fan 5B, a fan 5C, and a fan 5D.

On the top frame 60, the bell mouth 6A, a bell mouth 6B, a bell mouth 6C, and a bell mouth 6D are provided. The fans 5A, 5B, 5C, and 5D are located respectively in the bell mouths 6A, 6B, 6C, and 6D.

The air outlet 14 is formed at an upper end portion of each of the bell mouths 6A, 6B, 6C, and 6D. The chilling unit 100 is of a "top-flow configuration" in which the outlet of the fan 5 is oriented upward. The air outlet 14 of each of the bell mouths 6A, 6B, 6C, and 6D is provided with a fan guard 17, such that each of the fans 5A, 5B, 5C, and 5D is covered with the fan guard 17.

Figure 4:
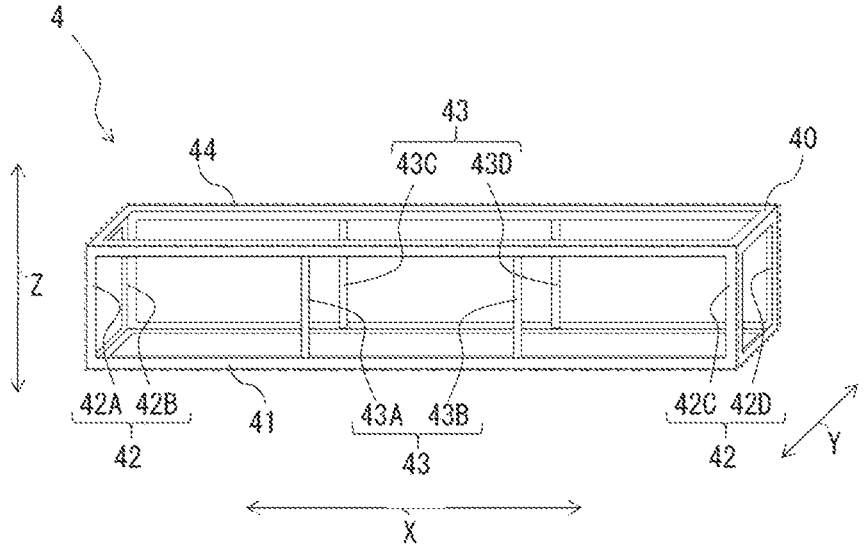
FIG. 4 is a conceptual view schematically illustrating the structure of a machine chamber unit 4 illustrated in FIG. 1.

FIG. 4 is a conceptual view schematically illustrating the structure of the machine chamber unit 4 illustrated in FIG. 1. In FIGS. 1 and 4, the space occupied by the machine chamber unit 4 is illustrated by the dotted lines. With reference to FIGS. 1 and 4, the structure of the machine chamber unit 4 is described below. The machine chamber unit 4 is formed in an elongated box shape, and formed into a cuboid. The machine chamber unit 4 has a frame 40 formed into a cuboid, and a side wall 45 covering the space between pieces of the frame 40.

The frame 40 has a base frame 41, a corner pillar 42, an intermediate pillar 43, and an upper beam 44. The corner pillar 42 includes four corner pillars 42, which are a corner pillar 42A, a corner pillar 42B, a corner pillar 42C, and a corner pillar 42D. The intermediate pillar 43 includes four intermediate pillars 43, which are an intermediate pillar 43A, an intermediate pillar 43B, an intermediate pillar 43C, and an intermediate pillar 43D. The base frame 41 is formed into a rectangular shape in plan view, and corresponds to the bottom portion of the frame 40.

The corner pillars 42A, 42B, 42C, and 42D are provided at respective four corners of the base frame 41 and extend in a direction perpendicular to the base frame 41. The intermediate pillars 43A and 43B are provided between the corner pillars 42A and 42C, and are spaced apart from each other in the longitudinal direction (X-axis direction) of the base frame 41. The intermediate pillars 43C and 43D are provided between the corner pillars 42B and 42D, and are spaced apart from each other in the longitudinal direction (X-axis direction) of the base frame 41. The intermediate pillars 43A, 43B, 43C, and 43D are provided and extend in a direction perpendicular to the base frame 41. The upper beam 44 is provided on the top of the corner pillars 42A, 42B, 42C, and 42D and the intermediate pillars 43A, 43B, 43C, and 43D. Note that the structure of the frame 40 described above is merely an example, and is not limited to the above frame components provided that the machine chamber unit 4 is formed into a cuboid.

A base 10 is provided on the upper beam 44 of the machine chamber unit 4. The base 10 is supported by the corner pillars 42 and the intermediate pillars 43. The air heat exchangers 1A, 1B, 1C, and 1D described above are located on the base 10. That is, a plurality of air heat exchangers 1 are placed on a top portion of the machine chamber unit 4. The top portion of the machine chamber unit 4 is provided with drain pans 55. Each of the drain pan 55 is formed to receive water droplets drained through the air heat exchanger 1. The drain pan 55 is located below the air heat exchanger 1 to receive water droplets dropping from the air heat exchanger 1. The drain pan 55 is provided and extends in the longitudinal direction (X-axis direction) of the machine chamber unit 4. The drain pan 55 accumulates water droplets naturally falling from the air heat exchanger 1 by gravity as drain water to guide the drain water to a discharge port (not illustrated).

The side wall 45 includes first side walls 45*a* and machine chamber panels 45*b*. The first side walls 45*a* are located at respective opposite end portions of the machine chamber unit 4 in the longitudinal direction (X-axis direction). The machine chamber panels 45*b* are located at respective opposite end portions of the machine chamber unit 4 in the short-side direction (Y-axis direction). Each of the first side walls 45*a* is a plate-like side wall that is provided and extends in the up-down direction (Z-axis direction) and in the short-side direction (Y-axis direction). One of the first side walls 45*a* is located and covers the space defined between the corner pillar 42A and the corner pillar 42B. The other first side wall 45*a* is located and covers the space defined between the corner pillar 42C and the corner pillar 42D. Each of the machine chamber panels 45*b* is a side wall that is provided and extends in the up-down direction (Z-axis direction) and in the longitudinal direction (X-axis direction). Some of the machine chamber panels 45*b* are located and cover the space defined between the corner pillar 42A and the intermediate pillar 43A, cover the space defined between the intermediate pillar 43A and the intermediate pillar 43B, and cover the space defined between the intermediate pillar 43B and the corner pillar 42C. The other machine chamber panels 45*b* are located and cover the space defined between the corner pillar 42B and the intermediate pillar 43C, cover the space defined between the intermediate pillar 43C and the intermediate pillar 43D, and cover the space defined between the intermediate pillar 43D and the corner pillar 42D.

Figure 5:
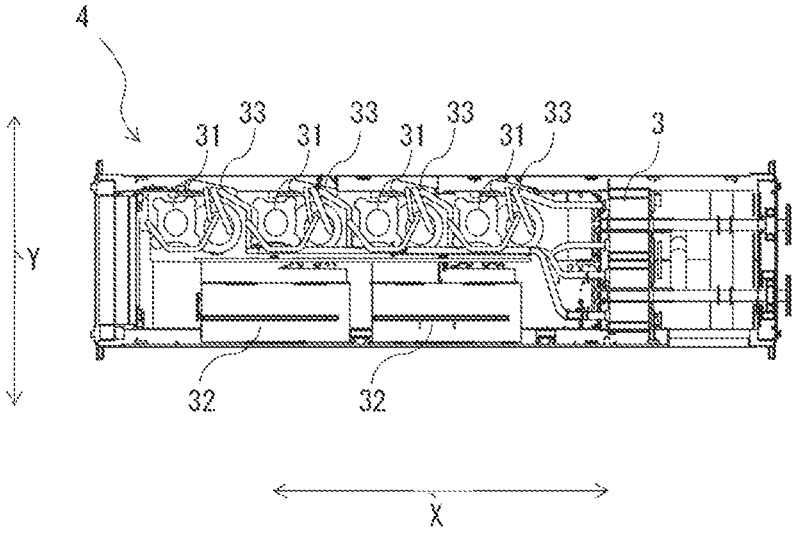
FIG. 5 is a plan view schematically illustrating the internal structure of the machine chamber unit 4 illustrated in FIG. 1.

FIG. 5 is a plan view schematically illustrating the internal structure of the machine chamber unit 4 illustrated in FIG. 1. The machine chamber unit 4 has compressors 31, flow switching devices 33, a heat exchanger 3, and a pressure-reducing device (not illustrated) housed in the machine chamber unit 4. The compressors 31, the flow switching devices 33, the heat exchanger 3, the pressure-reducing device, and the air heat exchangers 1 are connected in series by refrigerant pipes, forming a refrigerant circuit. In a plurality of chilling units 100, respective heat exchangers 3 are connected in parallel to each other by water pipes. A pump unit (not illustrated) causes heat transfer fluid in the water pipes to pass through the heat exchangers 3 and circulate to the load-side unit (not illustrated). A plurality of devices installed in the machine chamber unit 4 include control boxes 32.

Each of the compressors 31 is configured to suck refrigerant in a low-temperature and low-pressure state, compress the sucked refrigerant into a high-temperature and high-pressure state, and discharge the compressed refrigerant. Each of the flow switching devices 33 is, for example, a four-way valve, and is configured to switch between refrigerant flow passages under control of a controller (not illustrated). The heat exchanger 3 is configured to allow refrigerant and heat transfer fluid such as water and antifreeze to exchange heat between them. The pressure-reducing device is, for example, an expansion valve to reduce the refrigerant pressure. Each of the control boxes 32 houses, in its inside, for example, a control substrate configured to control the flow switching devices 33, a control substrate configured to control the opening degree of the pressure-reducing device and other conditions, or an inverter substrate configured to control the rotation speed of the compressors 31 and other conditions.

The machine chamber unit 4 may have heaters 57. In a case where the chilling unit 100 is operated in a cold region, there may be a problem with treatment of ice remaining in the drain pans 55. The chilling unit 100 has the heaters 57, and thus uses the heaters 57 during operation in a cold region to help melt ice in the drain pans 55 or prevent the drain water from freezing. In a case where the machine chamber unit 4 has the heaters 57, each of the heaters 57 is located in the vicinity of the air heat exchanger 1. For example, the heater 57 is located above the drain pan 55 such that the heater 57 extends along the lower end portion 11*b* of the air heat exchanger 1 in the longitudinal direction (X-axis direction) of the machine chamber unit 4.

[Operation of Chilling Unit 100]

The chilling unit 100 uses the fan 5 to cause air from the outside to pass through the air heat exchanger 1 to allow the air and refrigerant in the air heat exchanger 1 to exchange heat between them, and discharge the air having exchanged heat with the refrigerant from its upper portion. The chilling unit 100 is capable of switching between cooling operation and heating operation by switching between the refrigerant flow passages through the flow switching devices 33. In the cooling operation, the air heat exchanger 1 serves as a condenser, while the heat exchanger 3 serves as an evaporator. In the heating operation, the air heat exchanger 1 serves as an evaporator, while the heat exchanger 3 serves as a condenser. In the cooling operation, the chilling unit 100 generates heat transfer fluid cooled in the heat exchanger 3, and supplies this cooled heat transfer fluid to, for example, the load-side unit (not illustrated) to cool air on the load side (indoor side) to perform cooling in the room. In the heating operation, the chilling unit 100 generates heat transfer fluid heated in the heat exchanger 3, and supplies this heated heat transfer fluid to, for example, the load-side unit (not illustrated) to heat air on the load side (indoor side) to perform heating in the room.

[Machine Chamber Unit 4]

Figure 6:
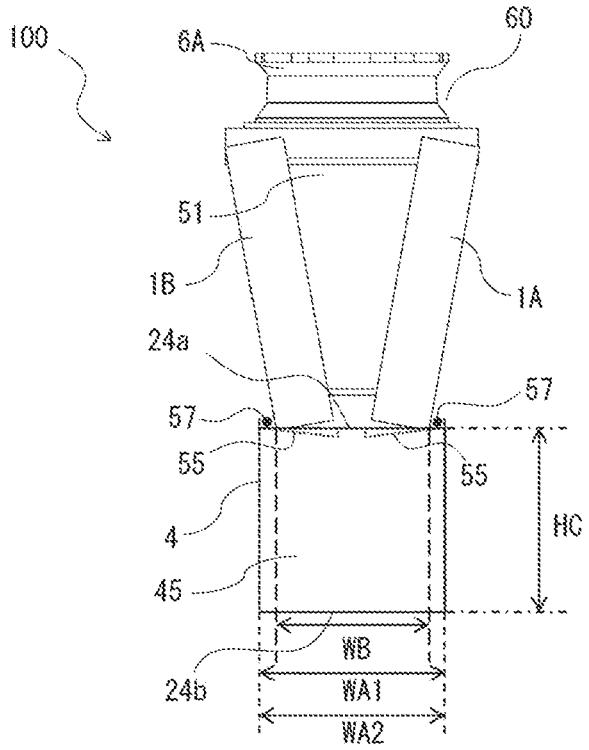
FIG. 6 is a conceptual view illustrating the relationship between an air heat exchanger 1 and the machine chamber unit 4 in the chilling unit 100 according to Embodiment 1.

FIG. 6 is a conceptual view illustrating the relationship between the air heat exchanger 1 and the machine chamber unit 4 in the chilling unit 100 according to Embodiment 1. For the sake of explaining the relationship between the air heat exchanger 1 and the machine chamber unit 4, FIG. 6 omits illustrations of some of the components, such as the support pillars 70. In the short-side direction (Y-axis direction) of the chilling unit 100, the width of an upper face portion 24*a* of the machine chamber unit 4 between the side walls is defined as an upper width WA1. The width between outer side surfaces of the lower end portions 11*b* of the pair of air heat exchangers 1 that are the air heat exchangers 1A and 1B is defined as a heat-exchanger lower width WB. As described above, in the short-side direction (Y-axis direction) of the machine chamber unit 4, the air heat exchanger 1A and the air heat exchanger 1B are located opposite to each other. As illustrated in FIG. 6, the chilling unit 100 has the upper width WA1 greater than the heat-exchanger lower width WB. That is, the chilling unit 100 is formed such that the condition is satisfied that upper width WA1>heat-exchanger lower width WB.

In addition, the chilling unit 100 is formed such that the condition is satisfied that the difference between the upper width WA1 and the heat-exchanger lower width WB is smaller than or equal to 50 mm. That is, the chilling unit 100 is formed such that the condition is satisfied that 0 mm<upper width WA1−heat-exchanger lower width WB≤50 mm.

Further, in the short-side direction (Y-axis direction) of the machine chamber unit 4, the width of a bottom face portion 24*b* of the machine chamber unit 4 between the side walls is defined as a lower width WA2. In the up-down direction (Z-axis direction) perpendicular to the longitudinal direction (X-axis direction) and the short-side direction (Y-axis direction) of the machine chamber unit 4, a dimension between the upper face portion 24*a* and the bottom face portion 24*b* of the machine chamber unit 4 is defined as a height dimension HC. In this case, the machine chamber unit 4 may be formed in dimensions in which the upper width WA1, the lower width WA2, and the height dimension HC are equal to each other. In other words, in the chilling unit 100, the upper width WA1 and the lower width WA2 of the machine chamber unit 4 may be set equal to each other, while the height dimension HC of the machine chamber unit 4 may be set equal to the upper width WA1 and the lower width WA2. That is, the chilling unit 100 may be formed such that the condition (upper width WA1=lower width WA2)=height dimension HC is satisfied in some cases.

The chilling unit 100 is formed such that the upper width WA1 of the machine chamber unit 4 is greater than the heat-exchanger lower width WB of the pair of air heat exchangers 1. However, the upper width WA1 may be equal to the heat-exchanger lower width WB. The machine chamber unit 4 in the chilling unit 100 is covered with the machine chamber panels 45*b* in the Y-direction. The machine chamber panels 45*b* are formed to close the openings defined by the base frame 41, the corner pillar 42, the intermediate pillar 43, and the upper beam 44 illustrated in FIG. 4 to protect the devices inside the machine chamber unit 4. The machine chamber panels 45*b* are located such that each of the plurality of openings illustrated in FIG. 4 is closed. Therefore, in Embodiment 1, three machine chamber panels 45*b* are attached to each end face of the machine chamber unit 4 in the Y-direction illustrated in FIG. 4.

Figure 7:
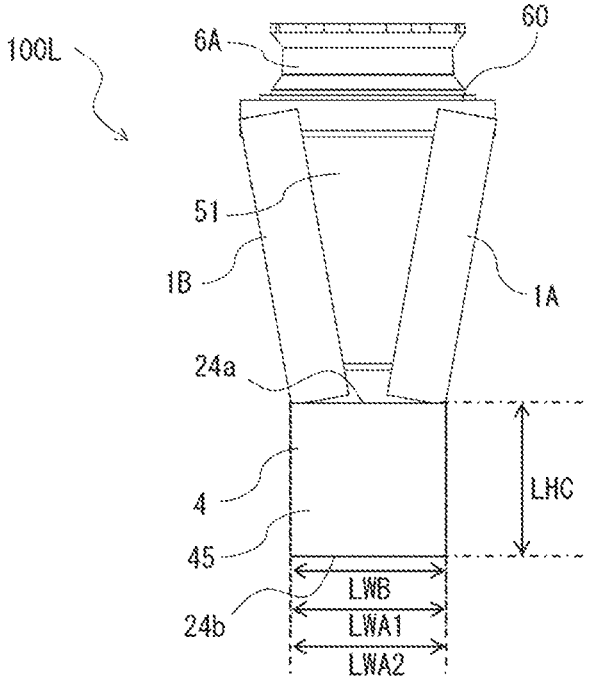
FIG. 7 is a front view of a chilling unit 100L as a modification of the chilling unit 100 according to Embodiment 1.

FIG. 7 is a front view of a chilling unit 100L as a modification of the chilling unit 100 according to Embodiment 1. In the short-side direction (Y-axis direction) of the chilling unit 100L, the width of the upper face portion 24*a* of the machine chamber unit 4 between the side walls is defined as an upper width LWA1. The width between outer side surfaces of the lower end portions 11*b* of the pair of air heat exchangers 1 that are the air heat exchangers 1A and 1B is defined as a heat-exchanger lower width LWB. Further, in the short-side direction (Y-axis direction) of the machine chamber unit 4, the width of the bottom face portion 24*b* of the machine chamber unit 4 between the side walls is defined as a lower width LWA2. Furthermore, in the up-down direction (Z-axis direction) of the machine chamber unit 4, a dimension between the upper face portion 24*a* and the bottom face portion 24*b* of the machine chamber unit 4 is defined as a height dimension LHC. The chilling unit 100L is formed such that the upper width LWA1 of the machine chamber unit 4 is equal to the heat-exchanger lower width LWB of the pair of air heat exchangers 1. The chilling unit 100L is formed into such a size that the upper width LWA1 of the machine chamber unit 4 is equal to the heat-exchanger lower width LWB of the pair of air heat exchangers 1. Consequently, compared to the chilling unit 100, there is less extra space inside the machine chamber unit 4. This gives the chilling unit 100L limited flexibility in layout of the constituent devices of the refrigerant circuit, such as the compressor 31, in routing the pipes, or other status.

Figure 8:
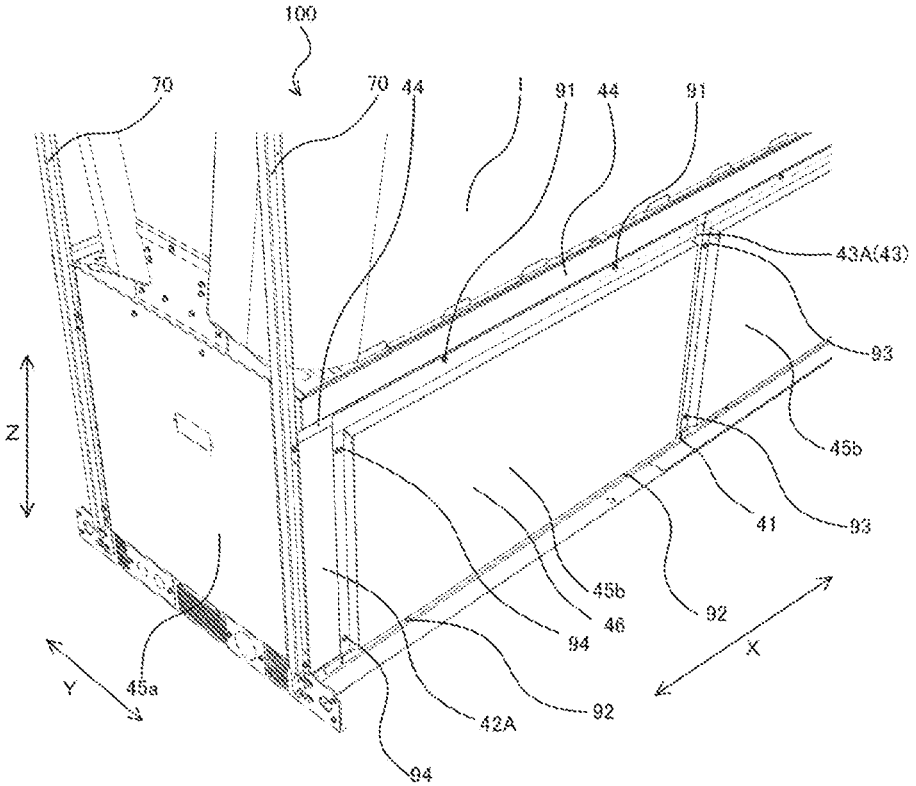
FIG. 8 is an enlarged perspective view of machine chamber panels 45*b* and their surroundings in the chilling unit 100 according to Embodiment 1.
Figure 9:
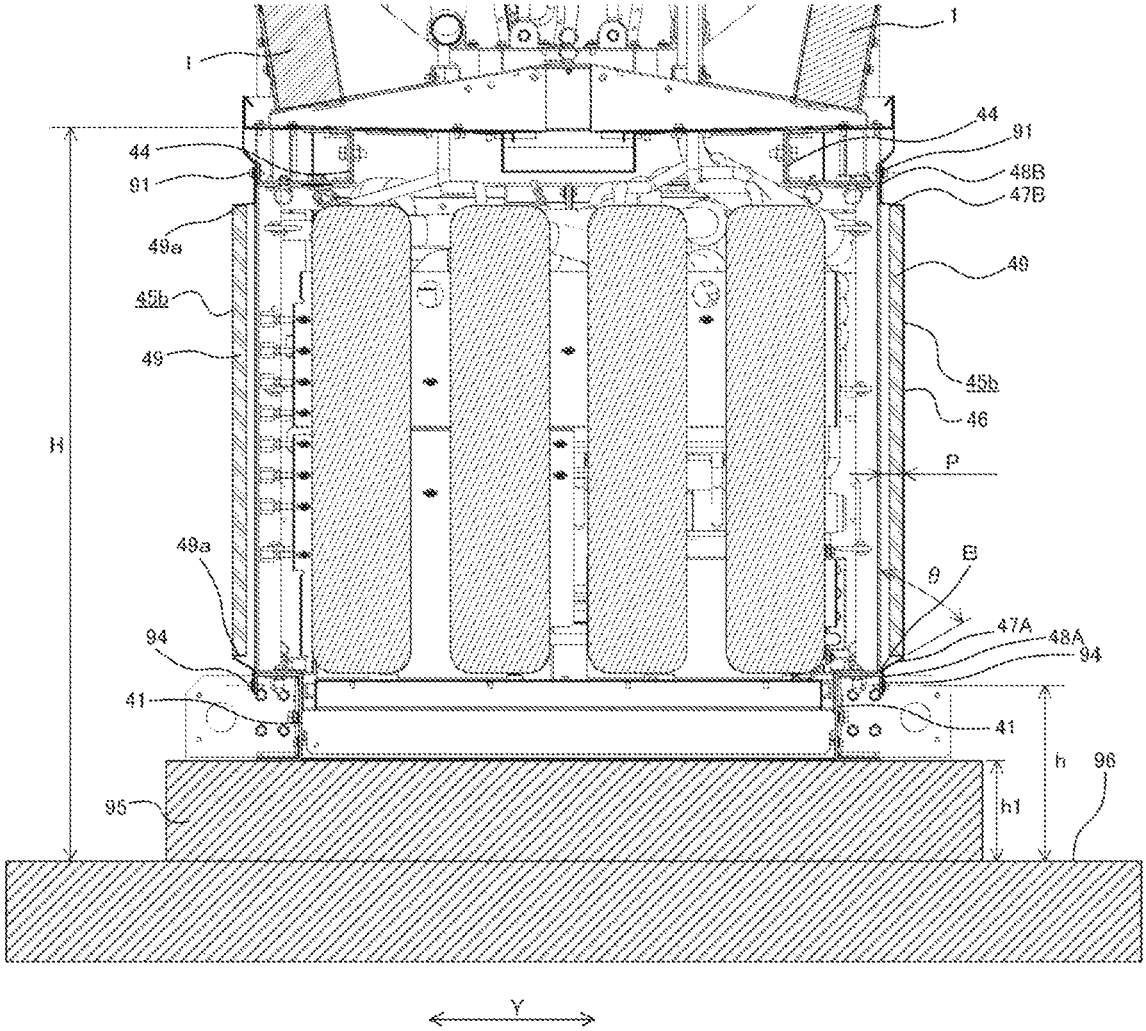
FIG. 9 is a cross-sectional view of the machine chamber unit 4 of the chilling unit 100 according to Embodiment 1.
Figure 10:
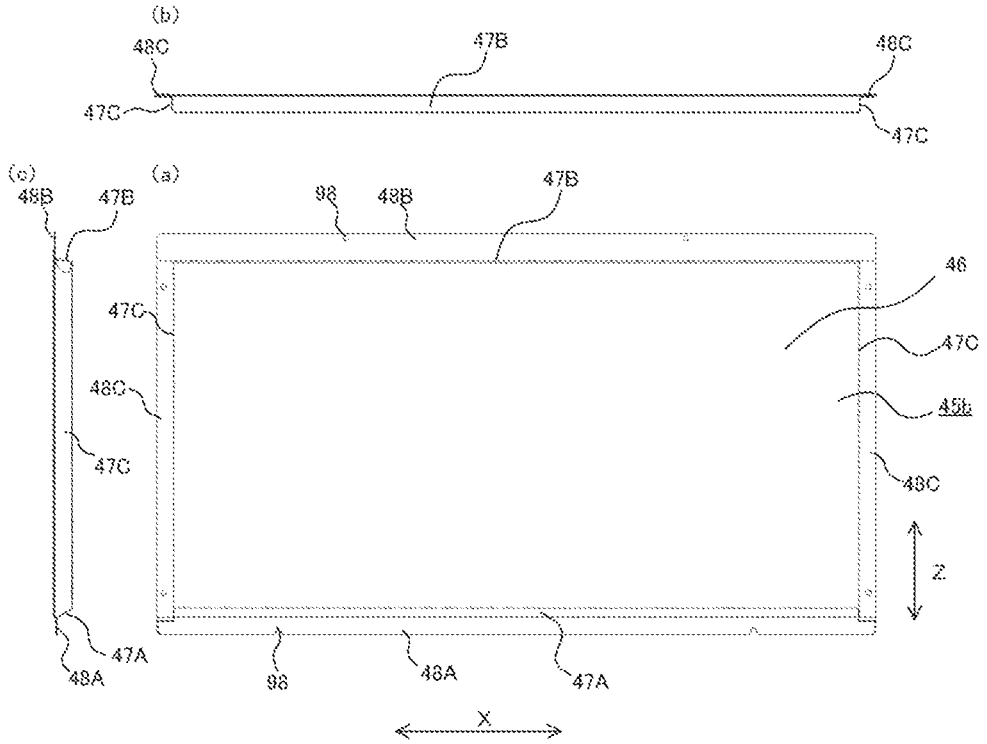
FIG. 10 are three-view drawings of a single machine chamber panel 45*b*.
Figure 11:
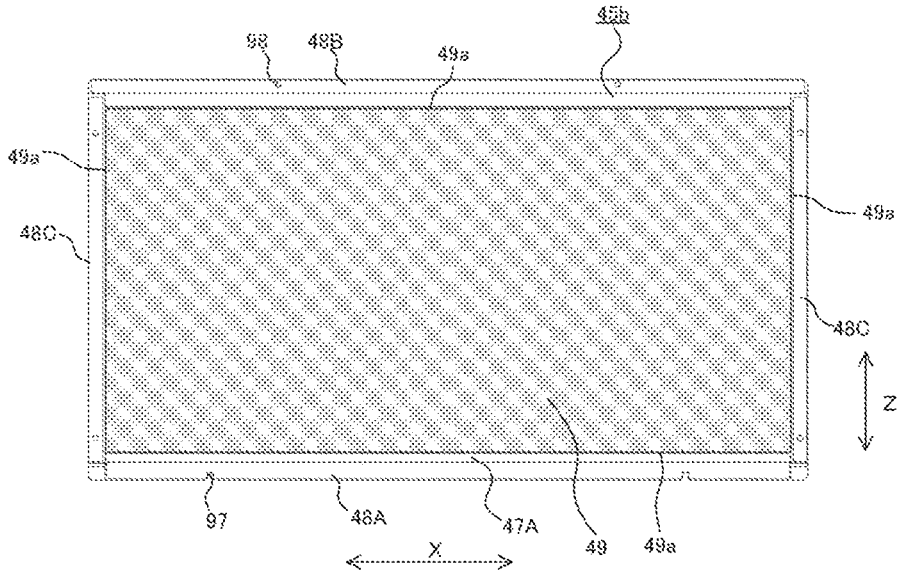
FIG. 11 is a rear view of the machine chamber panel 45*b*.

FIG. 8 is an enlarged perspective view of the machine chamber panels 45*b* and their surroundings in the chilling unit 100 according to Embodiment 1. FIG. 9 is a cross-sectional view of the machine chamber unit 4 of the chilling unit 100 according to Embodiment 1. FIG. 10 are three-view drawings of a single machine chamber panel 45*b*. FIG. 11 is a rear view of the machine chamber panel 45*b*. The machine chamber panels 45*b* of the chilling unit 100 according to Embodiment 1 form each end face of the machine chamber unit 4 in the Y-direction.

As illustrated in FIG. 9, each of the machine chamber panels 45*b* has a panel body 46 having a flat-plate shape and covering the opening of the machine chamber unit 4. A heat insulating part 49 is fixed to a face of the panel body 46 facing toward the inside of the machine chamber unit 4. The heat insulating part 49 has an outer peripheral end face 49*a* formed into a rectangular shape. The heat insulating part 49 is formed in a uniform thickness in its entirety. The outer peripheral end face 49*a* of the heat insulating part 49 is located along an outer edge of the panel body 46. Therefore, the panel body 46 is covered in substantially its entirety with the heat insulating parts 49 having a uniform thickness.

As illustrated in FIGS. 10, the machine chamber panel 45*b* includes fixing portions 48A, 48B, and 48C, which are fixed to the base frame 41, the corner pillar 42, the intermediate pillar 43, and the upper beam 44. The panel body 46 is located at a position apart from the fixing portions 48A, 48B, and 48C in the Y-direction. The machine chamber panel 45*b* further includes connection portions 47A, 47B, and 47C connecting the outer edge of the panel body 46 and the fixing portions 48A, 48B, and 48C. The connection portion 47A is formed to connect the fixing portion 48A positioned at the lower portion of the chilling unit 100 and the panel body 46, and is particularly referred to as "lower connection portion 47A."

The connection portion 47B is positioned at the upper portion of the machine chamber panel 45*b*, and the connection portions 47C are positioned at respective horizontally opposite end portions of the machine chamber panel 45*b*. The connection portions 47B and 47C rise nearly perpendicular to the fixing portions 48B and 48C and the panel body 46. In contrast, at the lower connection portion 47A, an inclination angle θ is largely inclined to the fixing portions 48A, 48B, and 48C, and the panel body 46. The inclination angle θ is defined as an inclination angle inclined to the plane of the fixing portions 48A, 48B, and 48C, and the plane of the panel body 46, and in other words, an inclination angle inclined to the vertical plane.

As illustrated in FIG. 11, on the machine chamber panel 45*b*, the heat insulating part 49 is located higher than the lower connection portion 47A. On the machine chamber panel 45*b*, the panel body 46 is located at a position further outward from the machine chamber unit 4 than are the fixing portions 48A, 48B, and 48C. The machine chamber panel 45*b* thus has a larger surface area and its condensation amount tends to increase accordingly, compared to some panel simply made up of a flat plate. Even when water condensed in the machine chamber unit 4 flows down along the panel body 46, the machine chamber panel 45*b* according to Embodiment 1 has the lower connection portion 47A inclined downward, and still helps prevent stagnation of the condensed water. This helps prevent corrosion due to the stagnant water in the lower portion of the machine chamber panel 45*b*. This also helps prevent the external appearance from being damaged by generation of rust.

The machine chamber panel 45*b* is fastened and fixed with the fixing portions 48A, 48B, and 48C being in contact with the base frame 41, the corner pillar 42, the intermediate pillar 43, and the upper beam 44 of the machine chamber unit 4, and with bolts 91, 92, 93, and 94 inserted through bolt insertion holes 98 and bolt insertion notches 97. At this time, the bolts 92 that fix the fixing portion 48A positioned at the lower portion of the machine chamber panel 45*b* are formed in such a manner that the bolts 92 are allowed to be visually checked from the obliquely above since the lower connection portion 47A is inclined. In Embodiment 1, a protruding amount P of the panel body 46 from the fixing portions 48A, 48B, and 48C is set to 30 mm, and the inclination angle θ of the lower connection portion 47A inclined to the vertical direction is set smaller than or equal to 50 degrees, for example.

Figure 12:
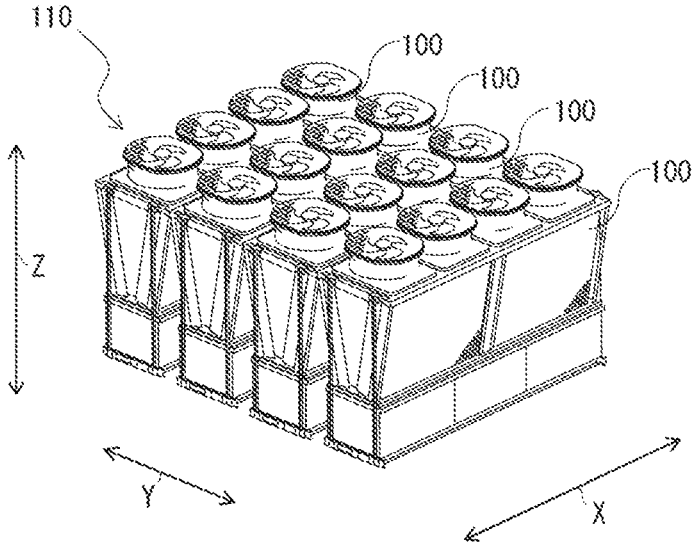
FIG. 12 is a perspective view of a chilling-unit system 110 according to Embodiment 1.
Figure 13:
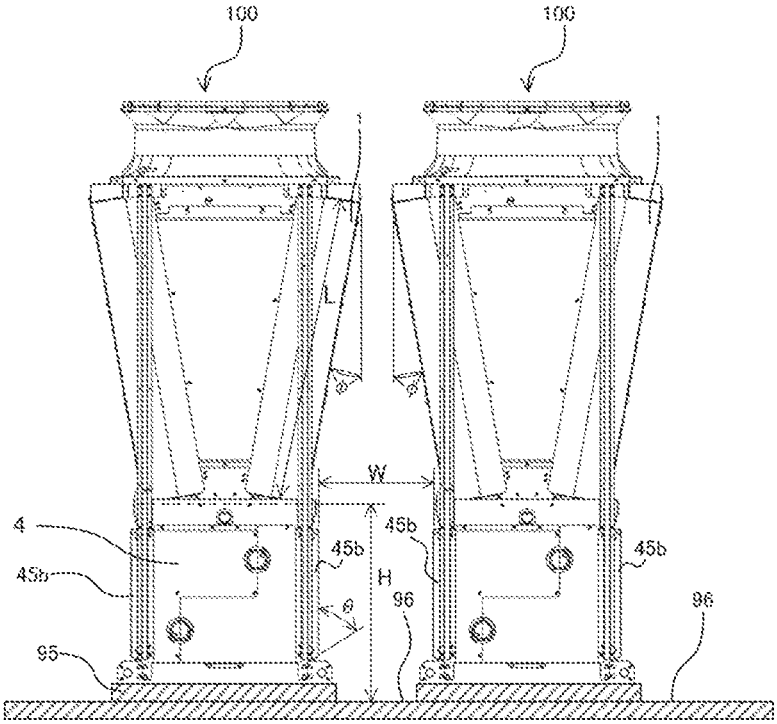
FIG. 13 is a conceptual view illustrating the relationship between two adjacent chilling units 100 included in the chilling-unit system 110 according to Embodiment 1.

FIG. 12 is a perspective view of the chilling-unit system 110 according to Embodiment 1. FIG. 13 is a conceptual view illustrating the relationship between two adjacent chilling units 100 included in the chilling-unit system 110 according to Embodiment 1. As illustrated in FIG. 12, the chilling-unit system 110 has a plurality of chilling units 100. The chilling-unit system 110 is made up of the plurality of chilling units 100 arranged side by side in the short-side direction (Y-axis direction). The chilling-unit system 110 is installed in such a manner that the plurality of chilling units 100 are located parallel to each other in the longitudinal direction (X-axis direction). As illustrated in FIG. 13, in the chilling-unit system 110, a spacing W between machine chamber units 4 of the two adjacent chilling units 100 in the short-side direction (Y-axis direction) of the chilling units 100 is set greater than or equal to 350 mm. The spacing W corresponds to a spacing between the outside faces of panel bodies 46 of machine chamber panels 45*b*. This spacing W is set in consideration of ease of maintenance of the plurality of chilling units 100.

A space between two chilling units 100 is also utilized as a workspace for a worker to enter and perform maintenance on the chilling units 100. On a floor surface 96 of the space, machine bases 95 are formed on which the chilling units 100 are installed. Each of the machine bases 95 has a height h1 that is set to approximately 200 mm. The height H of the machine chamber unit 4 from the floor surface 96 is set larger than or equal to 650 mm. The height of the machine chamber unit 4 is set such that the machine chamber unit 4 accommodates, in its inside, devices to be located inside the machine chamber unit 4, and also such that when the chilling units 100 are arranged side by side as illustrated in FIGS. 12 and 13, an adequate space is ensured between the chilling units 100 to allow a worker to enter and perform maintenance work. In general, a necessary height for a worker to work in the space with the worker's body bending down is greater than or equal to 650 mm. The machine chamber unit 4 ensures the height H of 650 mm or greater from the floor surface 96. The height of the machine base 95 may be varied to ensure the height H. It is desirable to ensure the spacing W of 350 mm or greater for a worker to enter the space between two chilling units 100.

A case is described below, where a worker enters the space between two chilling units 100 and removes the machine chamber panels 45*b*. As illustrated in FIG. 9, in the chilling-unit system 110 according to Embodiment 1, each of the bolts 94 for the fixing portion 48A positioned at the lower end of the machine chamber panel 45*b* of the chilling unit 100 is at a position of height h, for example, 277 mm from a floor surface 65. In a case where an origin B of the lower connection portion 47A in the vicinity of the fixing portion 48A is closest possible to the bolt 94, the inclination angle θ of the lower connection portion 47A is at least set equal to 50 degrees or smaller. This makes it possible for a worker to remove the bolt 94 in normal working posture of the worker (in a naturally bending-down posture) while the worker is visually checking the bolt 94.

Figure 14:
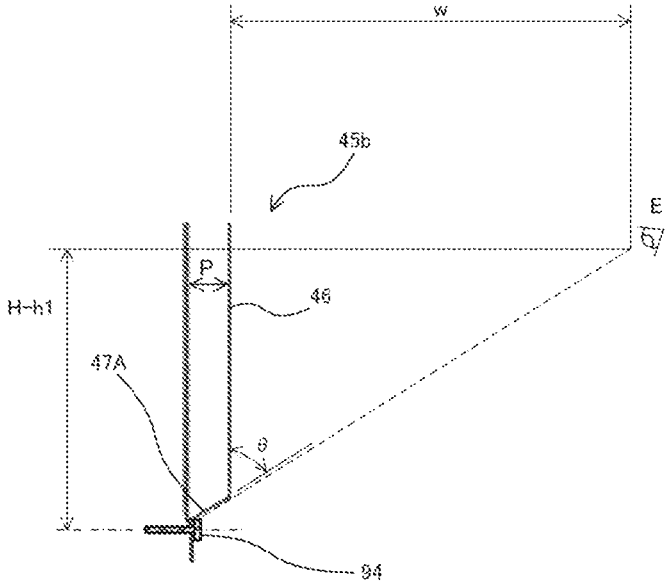
FIG. 14 is an explanatory view illustrating the relationship between the worker's line of sight and a lower connection portion 47A according to Embodiment 1.

FIG. 14 is an explanatory view illustrating the relationship between the worker's line of sight and the lower connection portion 47A in Embodiment 1. In order that a worker may visually check the bolt 94 from a worker's point of sight E, it is necessary to set the inclination angle θ of the lower connection portion 47A to fall within a range appropriate to a height H of the point of sight E and a distance w from the machine chamber panel 45*b*. The worker's point of sight E during normal maintenance work is at a position of the height H at the upper end of the machine chamber unit 4 from the floor surface 96. The reason for this is that in the upper portion of the chilling unit 100, the air heat exchanger 1 is located protruding outward from the machine chamber unit 4 by an inclination angle φ, and thus the worker needs to bend down to avoid contact with the protrusion during the work. For example, the worker's point of sight E is at a position of H–h1=650 mm–277 mm=373 mm, and w=300 mm. In a case where the origin B of the lower connection portion 47A is closest possible to the bolt 94, where the inclination angle θ of the lower connection portion 47A satisfies $$\theta \leq \tan^{-1}\{w/(H-h1)\}, \quad (1)$$

then, the worker is allowed to visually check the bolt 94 from the point of sight E. That is, where θ≤39 degrees is satisfied, the machine chamber panel 45*b* does not block a worker from visually checking the bolt 94 during normal work.

Note that as illustrated in FIG. 13, the spacing W between adjacent chilling units 100 is dependent on the inclination angle q of the air heat exchanger 1 and is represented as W=2L sin φ. L represents a dimension of the air heat exchanger 1 in a direction along the inclination of the air heat exchanger 1, while φ represents the inclination angle of the air heat exchanger 1 inclined to the vertical direction. Alternatively, in consideration of an upper gap between the adjacent chilling units 100, the spacing W between the adjacent chilling units 100 is set to W≥2L sin θ. Thus, provided that the worker's point of sight E when the worker enters and works in the space between the chilling units 100 is at a position approximately a half of the spacing W, the worker is allowed to easily work in the space. Therefore, a position w of the point of sight E in FIG. 14 is replaced with W/2, and the inclination angle θ of the lower connection portion 47A is set to $\theta \leq \tan^{-1}\{L \sin \varphi/(H-h1)\}$. This makes it easier for the worker to visually check the bolt 94, and improves the work efficiency accordingly. Note that since the inclination angle α of the air heat exchanger 1 illustrated in FIG. 3 is 65 to 80 degrees, the inclination angle φ is 10 to 25 degrees accordingly. The dimension of the air heat exchanger 1 along a direction of its inclination is, for example, 1,400 mm.

In the machine chamber panel 45*b*, the protruding amount P of the panel body 46 is set to, for example, approximately 30 mm. With this setting, on the machine chamber panel 45*b*, the heat insulating part 49 with a uniform thickness is allowed to be fixed to the inside face of the panel body 46. When the machine chamber unit 4 is covered with some side walls in a simple flat plate shape, the heat insulating part 49 is partially notched or provided with a hole to avoid contact with the devices inside the machine chamber unit 4. However, in the machine chamber panel 45*b* according to Embodiment 1, the panel body 46 is located at a position further outward in the Y-direction than are the fixing portions 48A, 48B, and 48C. It is thus unnecessary to form the heat insulating part 49 to conform to the internal structure of the machine chamber unit 4. Therefore, three machine chamber panels 45*b* illustrated in FIG. 2 are of the same structure. It is thus unnecessary to manage the respective attachment positions of the three machine chamber panels 45*b* when the machine chamber panels 45*b* are removed or attached during maintenance work.

The protruding amount P of the panel body 46 is adequately set such that the machine chamber panel 45*b* increases the installation area of devices inside the housing without increasing the size of the machine chamber unit 4 in the Y-direction, that is, without increasing the spacing of the base frame 41 in the Y-direction. Note that the machine chamber panels 45*b* are removed during maintenance work, which prevents the workspace from being narrowed by the protruding amount P. Provided that at least ease of visual checking of the bolt 94 when the machine chamber panels 45*b* are to be removed is ensured, the maintenance work is performed without any problems. For example, the protruding amount P of the panel body 46 may be set to P≥30 mm in consideration of the configuration in which the heat insulating part 49 with a uniform thickness is installed on the inside of the panel body 46 substantially over its entire region, and devices are installed inside the machine chamber unit 4.

As illustrated in FIG. 12, a plurality of chilling units 100 according to Embodiment 1 are normally used with the plurality of chilling units 100 arranged side by side. However, even in a case where a single chilling unit 100 is installed, the lower connection portion 47A of the machine chamber panel 45*b* is inclined, which still helps prevent corrosion and improve work efficiency in removing and attaching the machine chamber panel 45*b*.

The configurations described in the foregoing embodiment are merely examples, and may thus be combined with another publicly known technique, or partially omitted and modified without departing from the scope of the present disclosure.

The invention claimed is:

1. A chilling unit comprising:

a machine chamber unit formed in an elongated box shape and that houses a compressor and a heat exchanger in the machine chamber unit; and a plurality of air heat exchangers making up, along with the compressor and the heat exchanger, a refrigerant circuit, the plurality of air heat exchangers being placed on a top portion of the machine chamber unit, a pair of air heat exchangers of the plurality of air heat exchangers, located opposite to each other in a short-side direction of the machine chamber unit, being disposed and inclined such that a spacing between upper end portions farther than lower end portions from the machine chamber unit is greater than a spacing between the lower end portions closer than the upper end portions to the machine chamber unit, a machine chamber panel forming a side face of the machine chamber unit in the short-side direction including a panel body positioned at a central portion of the machine chamber panel, and a fixing portion connected to a periphery of the panel body and fixed to the machine chamber unit in contact with the machine chamber unit, the panel body being located further outward from the machine chamber unit than is the fixing portion, the machine chamber panel including a lower-end fixing portion of the fixing portion, the lower-end fixing portion being positioned at a lower end portion of the machine chamber panel, and a lower connection portion connecting the panel body and the lower-end fixing portion, the lower connection portion being inclined downward from the panel body toward the lower-end fixing portion.

2. The chilling unit of claim 1, wherein the lower connection portion satisfies an expression:

$$\theta \leq \tan^{-1}\{(H - h1)/L\sin\varphi\}, \quad (1)$$

where a dimension L in a direction along an inclination of the plurality of air heat exchangers, an inclination angle φ of the plurality of air heat exchangers inclined to a vertical direction, a height H from a floor surface on which the chilling unit is installed to an upper end of the machine chamber unit, a height h1 from the floor surface to a bolt that fixes the lower connection portion, and an inclination angle θ of the lower connection portion inclined to a vertical direction are defined.

3. The chilling unit of claim 2, wherein the height H from the floor surface to the upper end of the machine chamber unit is greater than or equal to 650 mm, and the inclination angle θ of the lower connection portion is smaller than or equal to 39 degrees.

4. The chilling unit of claim 1, further comprising a heat insulating part that is fixed to a face of the panel body facing toward an inside of the machine chamber unit.

5. The chilling unit of claim 4, wherein the heat insulating part is formed in a rectangular shape with a uniform thickness, and has an outer peripheral end face located along an outer edge of the face of the panel body facing toward the inside of the machine chamber unit.

6. A chilling-unit system made up of a plurality of the chilling units of claim 1, wherein a spacing between the machine chamber units of two of the plurality of the chilling units adjacent to each other in the short-side direction is set greater than or equal to 350 mm.

7. The chilling unit of claim 2, further comprising a heat insulating part that is fixed to a face of the panel body facing toward an inside of the machine chamber unit.

8. The chilling unit of claim 3, further comprising a heat insulating part that is fixed to a face of the panel body facing toward an inside of the machine chamber unit.

9. The chilling unit of claim 7, wherein the heat insulating part is formed in a rectangular shape with a uniform thickness, and has an outer peripheral end face located along an outer edge of the face of the panel body facing toward the inside of the machine chamber unit.

10. The chilling unit of claim 8, wherein the heat insulating part is formed in a rectangular shape with a uniform thickness, and has an outer peripheral end face located along an outer edge of the face of the panel body facing toward the inside of the machine chamber unit.

* * * * *